US005603132A

United States Patent [19]

Zafiroglu

[11] Patent Number: 5,603,132

[45] Date of Patent: Feb. 18, 1997

[54] MATTRESS COVER WITH ELASTIC FITTED SKIRT

[75] Inventor: Dimitri P. Zafiroglu, Wilmington, Del.

[73] Assignee: E.I. du Pont de Nemours and Company, Wilmington, Del.

[21] Appl. No.: 605,562

[22] Filed: Feb. 22, 1996

[51] Int. Cl.[6] ..... A47G 9/04; D04B 21/18

[52] U.S. Cl. ..... 5/497; 5/499; 66/192

[58] Field of Search ..... 66/192, 196; 5/482, 5/497, 499

[56] References Cited

U.S. PATENT DOCUMENTS

| | | | |
|---|---|---|---|
| 3,413,825 | 12/1968 | Winch | 66/192 |
| 3,649,428 | 3/1972 | Hughes | 66/192 X |
| 3,835,512 | 9/1974 | Piller et al. | 66/192 X |
| 4,891,957 | 1/1990 | Strack et al. | 66/192 |
| 4,985,953 | 1/1991 | Seago | 5/499 X |
| 5,127,115 | 7/1992 | Williams et al. | 5/497 |
| 5,187,952 | 2/1993 | Zafiroglu | 66/192 |
| 5,247,893 | 4/1993 | Zafiroglu | 112/262.1 |
| 5,308,674 | 5/1994 | Zafiroglu | 66/192 X |
| 5,388,293 | 2/1995 | Kistmer | 5/482 X |

*Primary Examiner*—John J. Calvert

[57] ABSTRACT

A fitted mattress cover has a two-bar stitchbonded skirt that is stretchable by at least 50% and by at least 100% respectively in the longitudinal and transverse directions of the skirt, with at least 80% of the longitudinal stretch and at least 30% of the transverse stretch being elastically recoverable. The skirt is made with one bar forming tricot stitches with inelastic yarn and with the second bar forming a repeating pattern of 1-0, 0-1, 1-2, 2-1 stitches with elastic combination yarn.

3 Claims, 1 Drawing Sheet

MATTRESS COVER WITH ELASTIC FITTED SKIRT

BACKGROUND OF THE INVENTION

1. Field of the Invention

This invention relates to a fitted mattress cover that has a stretchable stitchbonded fabric skirt. More particularly, the invention concerns such a fitted mattress cover in which the stitchbonded skirt exhibits elastic stretch in both the longitudinal and transverse directions of the skirt and provides a smooth, snug fit to the mattress on which the cover is fitted.

2. Description of the Prior Art

Fitted mattress covers are well known. A typical fitted mattress cover comprises top panel and a skirt attached to and extending at about ninety degrees from the periphery of the panel. In use, the top panel covers the top of surface of the mattress and the skirt covers the sides of the mattress.

As used herein, the term "longitudinal direction" refers to the direction that follows around the long dimension of the sides of a mattress and the term "transverse direction" refers to the direction that is perpendicular to the longitudinal direction and is parallel to the thickness dimension of the mattress.

U.S. Pat. No. 4,985,953 discloses a fitted mattress pad cover that has a skirt formed of a gathered layer of inelastic material in which a plurality of spaced apart elastic cords are attached in the longitudinal direction parallel to the periphery of the top panel. The skirt material is elastic in a direction parallel to the elastic cords (i.e., in the longitudinal direction of the skirt) and inelastic in the transverse direction of the skirt.

Because mattresses are manufactured with a thickness that is typically in the range of about 7 to about 15 inches, various skirted mattress covers also have been disclosed for accommodating such different thicknesses, with the aim of providing one size of skirted mattress cover to fit mattresses of all conventional thicknesses.

U.S. Pat. Nos. 5,187,952 and 5,247,893, disclose a fitted mattress cover having an elastic fitted skirt. The skirt is formed from a stitchbonded fabric which comprises a substantially nonbonded fibrous layer in which elastic yarns, such as spandex elastomeric yarns, are stitched to create lanes of different stretchability in the fabric. The skirt material provides stretchability of 190% and 60% in the longitudinal direction in the first and second lanes, respectively, and provides 80 to 90% stretchability in the transverse direction. As a result of the different lane stretchabilities, the mattress cover skirts have a large over-all stretchability in the longitudinal direction, but no more than 90% over-all stretchability in the transverse direction. The lanes of different stretchability create a striped or banded appearance in the skirt fabric. Similar mattress covers having stitchbonded fabric skirts are disclosed in U.S. Pat. No. 5,127,115. The skirts have an elastic stretch of 60% in the longitudinal direction of the skirt and an inelastic stretch of about 30% in the transverse direction.

U.S. patent application Ser. No. 08/397,328, filed Mar. 2, 1995, discloses a fitted mattress cover having a stitchbonded skirt that does not have a banded appearance. The skirt has a stretchability that is greater in the transverse direction than in the longitudinal direction. The total stretchability in the longitudinal direction is less than about 60%, with less than one-third of the stretch being recoverable. The total stretchability in the transverse direction about 100 to 200% with less than half of the stretch being recoverable. Because less than half of the transverse stretch is recoverable (i.e., elastic), the skirt often does not have a neat and snug fit to the sides and edges of the mattress.

Each of the known fitted mattress covers have found some success in the bedding market, but further improvements are desired. For example, skirts of such mattress covers typically had very little or no transverse elastic stretch. Also, skirts which were elastic only at the edges of the cover often did not fit the mattress properly along the entire thickness of the mattress. Accordingly, the aim of this invention is to provide a fitted mattress cover that has elastic stretch in both the longitudinal and transverse directions of the skirt, that can fit mattresses of different thicknesses and that retains these desirable characteristics even after several launderings.

SUMMARY OF THE INVENTION

The present invention provides an improved mattress cover. The mattress cover comprises a top panel and a stitchbonded fabric skirt. In use, the top panel covers the top surface of a mattress and the skirt fits around the sides and ends of the mattress. The skirt has a longitudinal direction which is parallel to the periphery of the top panel, a direction transverse thereto, a top edge and a bottom edge. The top edge is attached to the periphery of the top panel and the skirt extends therefrom. The stitchbonded fabric skirt has rows of tricot stitches formed with conventional inelastic yarn extending in the longitudinal direction of the skirt. The bottom and top edges of the skirt optionally have elastic bands or yarns stitched in the edges.

According to the improvement of the invention, the stitchbonded fabric skirt is a two-bar fabric. One bar forms the tricot stitches with inelastic yarn and a second bar forms stitches with elastic combination yarn. Preferably, the fabric has a percent stretch in the longitudinal direction at least 50%, and a percent stretch in the transverse direction at least 100%, preferably at least 200%. At least 80% of the stretch in the longitudinal direction and at least 30% of the stretch in the transverse direction are elastically recoverable. It is also preferred that second bar of stitches formed with the elastic combination yarn be 1-0,0-1,1-2,2-1. Most preferably, the elastic combination yarns are of air-jet-entangled filaments of nylon and spandex. It is also preferred that the tricot stitches, which are 1-0,1-2 or 1-0,2-3 stitches, are formed with textured polyester yarns and that all the yarns are stitched into a substantially nonbonded spunlaced layer of polyester fibers.

BRIEF DESCRIPTION OF THE DRAWINGS

The invention will be better understood by reference to the drawings wherein.

DETAILED DESCRIPTION OF THE PREFERRED EMBODIMENT

For convenience and clarity, definitions will now be given of several terms that are used herein. "Stitchbonding" is a multi-needle stitching operation wherein spaced-apart rows of stitches are formed in a nonwoven substrate. The term "substantially nonbonded fibers" as used with reference to the nonwoven substrate means that the fibers generally are not bonded to each other, by thermal, chemical or other means. However, the term is intended to include a small amount of point bonding, line bonding or the like, as long as the bonding is not sufficient to prevent the stitchbonded fabric made therewith from extending and recovering from stretch. A "spunlaced fabric" is a nonwoven sheet of hydraulically entangled fibers. An "elastic combination yarn" is a yarn that has at least two dissimilar yarn components, one component being elastic and another being of conventional natural or synthetic fiber. "Spandex" is a manufactured fiber in which the fiber-forming substance is a long chain synthetic polymer that is comprised of at least 85% by weight segmented polyurethane. "Elastic" refers to the property of a fiber, yarn or fabric to stretch when under tension and then retract quickly and forcibly to its original length when the tension is released. Conventional yarns, such as of nylon, polyester, cotton, etc., are considered herein to be nonelastic. Conventional warp-knitting stitch nomenclature is used to identify the various types of stitches employed in the present invention.

Figure 1:
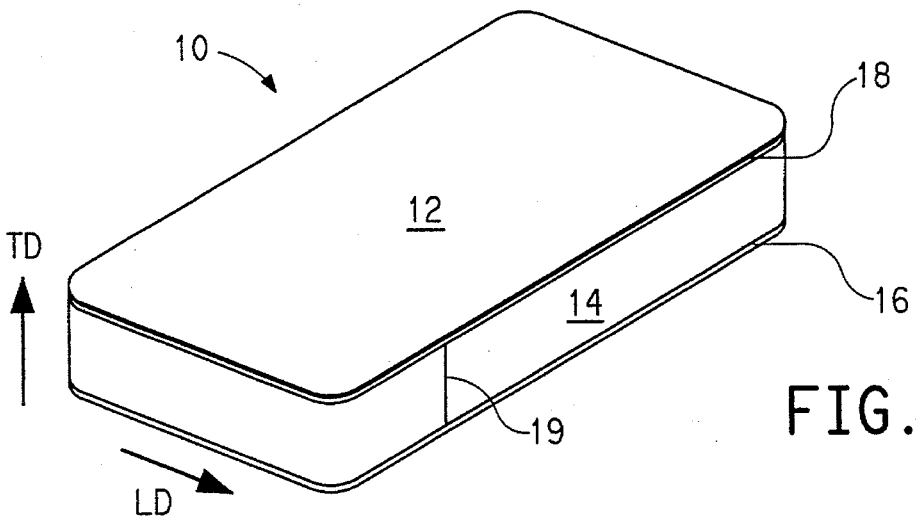
FIG. 1 is an isometric view of mattress cover 10 of the present invention.

Preferred embodiments of the invention will now be described with reference to the drawings. FIG. 1 shows a mattress cover 20 which comprises a top panel 12 and a skirt 14. Top panel 12 preferably is a quilted padding material which optionally may include a water impermeable layer. Typically, top panel 12 has dimensions which correspond approximately to the dimensions of the top of the mattress that is to be covered. Skirt 14 is a stitchbonded fabric that is elastically stretchable in both the longitudinal direction ("LD") and the transverse direction ("TD"). Skirt 14 also includes upper edge 18 and lower edge 16. Optionally, elastic combination yarns are also stitched into the lower edge 16 and/or upper edge 18 of the skirt fabric. Elastic stitching in bottom edge 16 serves to pull the bottom portion of skirt 14 underneath the mattress on which it is fitted. Usually, the portion of the skirt that fits under the mattress amounts to about five or more inches of skirt width (i.e., in the transverse dimension of the skirt). Elastic stitching in upper edge 18 serves to reinforce top edge 18 and provides an attachment location for attaching (usually by sewing) skirt 10 to top panel 12.

Skirt 14 is formed from a two-bar stitchbonded fabric. The fabric comprises a substantially nonbonded nonwoven fibrous substrate that is multi-needle stitched with two sets (or bars) of yarns. A preferred nonwoven fibrous substrate is a spunlaced sheet of hydraulically entangled polyester fibers, such as SONTARA®8017 spunlaced fabric, sold by E. I. du Pont de Nemours & Co.. One set of multi-needle stitching yarns forms tricot stitches in the nonwoven substrate. The tricot stitches preferably are formed with conventional, substantially-inelastic yarns, such as yarns of polyester fibers. Typically 1-0,1-2 or 1-0,2-3 tricot stitches are employed.

Figure 2:
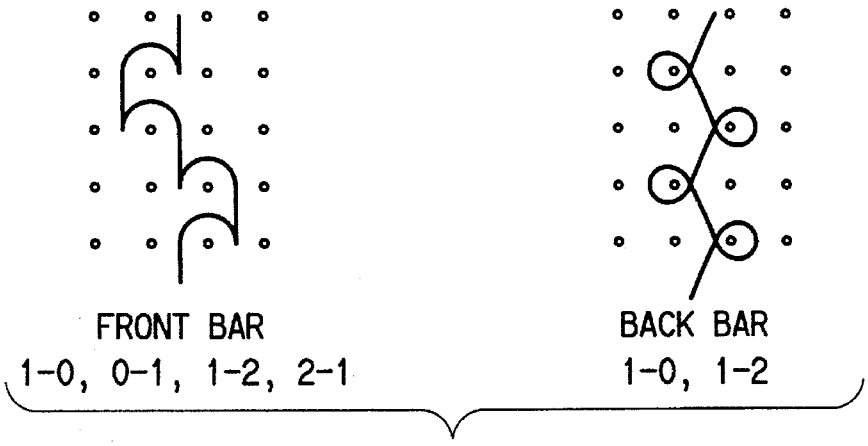
FIG. 2 is a stitch diagram employed to form the stitchbonded skirt fabric 14 of the Example below.

FIG. 2 displays a stitch diagram of the two-bar fabric prepared in the Example below. FIG. 2 indicates that the back bar of the stitchbonding machine forms a pattern of repeating 1-0,1-2 tricot stitches with inelastic yarn 20 and while the front bar of the machine forms pattern of repeating 1-0,0-1,1-2,2-1 stitches with elastic combination yarn 30.

Figure 3:
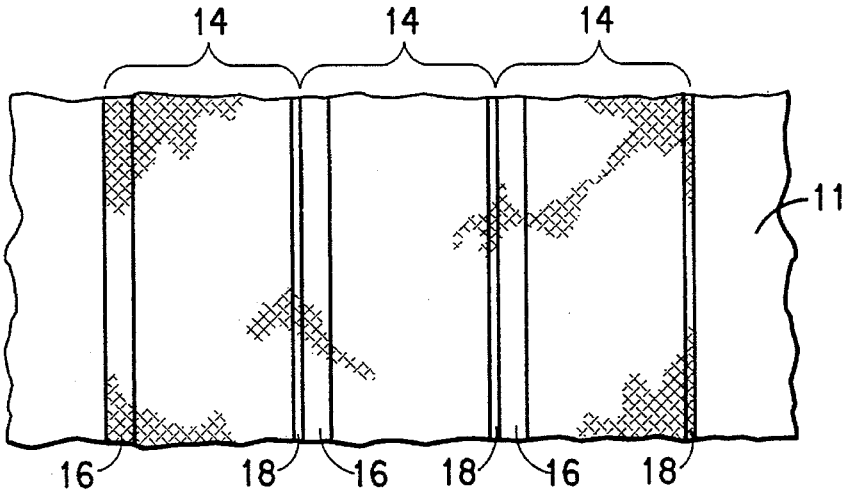
FIG. 3 illustrates an idealized plan view of three lengths of the skirt fabric of the Example as they are being formed simultaneously side by side on a stitchbonding machine.

FIG. 3, the idealized plan view of the skirt fabric of the Example as it is made on the stitchbonding machine, shows that special lanes of stitches are incorporated in the stitchbonding to form bottom edge 16 and upper edge 18 of skirt 14. These edges are readily formed by doubling or tripling the number of yarns in the needles forming the stitches in those rows, as explained further in the Example below.

The two-bar stitchbonded fabric employed to form skirt 14 of the invention has a uniform, smooth, knit-like surface appearance. Stitchbonded fabric skirt 14 exhibits substantial elastic stretch in the longitudinal direction as well as significant elastic stretch in the transverse direction of the skirt fabric. The stitchbonded fabric skirt has a percent stretch in the longitudinal direction of at least 50% and a percent stretch in the transverse direction of at least 100%. At least 80% of the stretch in the longitudinal direction and at least 30% of the stretch in the transverse direction are elastically recoverable.

Typically, stitchbonded fabric skirt 14 is about at least 10-inches (25-cm) wide (in the TD). With such a skirt width and the above-recited elastic stretch characteristics, the mattress cover of the invention can readily fit typical mattresses of 7-to-15-inches (18-to-38-cm) thick. At least about five inches (12.7 cm) of the skirt width fits under the mattress to which the cover is fitted.

The mattress cover of the invention is prepared by a process that comprises the steps of (a) forming the top panel, (b) forming the skirt material, (c) attaching the skirt material to the top panel.

Typically, the top panel is made by quilt stitching two layers of material with a filling material between the two layers. The top panel is formed or cut to substantially correspond in size to the top of the mattress to which the cover is to be fitted.

The skirt material is formed by a stitchbonding step in which a nonwoven layer of substantially nonbonded fibers are multi-needle stitched on a two-bar stitchbonding machine. A nonwoven layer of spunlaced staple polyester fibers is particularly suited for use as the nonwoven layer. For use in the present invention, spunlaced layers weighing less than 40 g/m$^2$ are preferred. Typically, the bars of needles have a "gage" in the range of 5 to 20 needles per 25 mm (corresponding to the cross-machine direction or transverse direction of the fabric to be formed) and inserts in the range of four 4 to 16 stitches or courses per inch (per 2.5 cm) in the machine direction (corresponding to the longitudinal direction of the fabric to formed). Known methods and equipment are employed to control the tension and feed rate of the yarns that are threaded through the needles and to control the rate of feed or over-feed of the nonwoven fibrous layer to the machine. Because typical stitchbonding machines are several meters wide, several skirts can be formed simultaneously on the stitchbonding machine.

After the top panel 12 and the skirt fabric 14 are formed, a length of the skirt fabric while under slight tension is attached to the top panel, typically sewing upper edge 18 of the skirt fabric to the periphery of the top panel. The length of the skirt material while under the slight tension equals the peripheral length of the top panel. To complete the cover, the ends of the attached skirt material are sewn together at seam 19, as indicated in FIG. 1.

TEST METHODS

The parameters of stretchability and elastic recovery of the skirt material discussed herein, are measured by the following procedures.

Longitudinal strips and transverse strips, each measuring 1-inch (2.5-cm) wide by 8-inches (20-cm) long, are cut from the skirt fabric. A standard length of 2.5 cm, parallel to the long edge of the strip, is marked near the middle of the strip.

The strip is clamped at opposite ends of a 5-cm length of the strip, with the initially marked 2.5-cm length centrally located between the clamps. The strip is then subjected to tension by suspending a 10-pound (4.54 kg) weight from the lower clamp. This load is usually sufficient to elongate strips from skirt fabrics described in the Examples below and simulates the amount of pull that is exerted on skirt material when as part of a mattress cover it is placed fitted onto a mattress. The extended length, $L_f$, of the original 2.5-cm mark is measured and the percent stretchability, % S, in a given direction is then calculated as a percentage of original length by the formula $$\%S=100(L_f-2.5)/2.5.$$

The recoverable or elastic stretch, %RS, is measured by removing the weight from the sample and after two minutes re-measuring the length, $L_r$, of the original 2.5-cm mark. The percent recoverable stretch is then calculated by the formula $$\%RS=100(L_f-L_r)/(L_f-2.5).$$

The invention is further illustrated by the following examples of preferred embodiments. These examples are included for purposes of illustration only and are not intended to limit the scope of the invention, which is defined by the appended claims.

EXAMPLE

This example describes the manufacture of a preferred fitted mattress cover of the invention which has a stitchbonded fabric skirt in accordance with the invention. The skirt has particularly favorable elastic stretch characteristics in the longitudinal and transverse directions of the skirt. The elastic retractive forces within the skirt after the skirt is stretched to fit on a mattress result in the skirt fitting smoothly, snugly and neatly around the sides and ends of the mattress.

The starting fibrous layer for the stitchbonded fabric was a 0.7 oz/yd$^2$ (23.7 g/m$^2$) SONTARA®8017 spunlaced sheet of hydraulically entangled polyester fibers of 1.35 denier (1.5 dtex) and ⅞-inch (2.2-cm) length. The spunlaced sheet was overfed 18% to a two-bar, 14-gage (i.e., 14 needles per 25 mm) multi-needle stitchbonding machine that was set to insert 11 courses of stitches per inch (4.3/cm) in the machine (longitudinal) direction of the sheet. The back bar of the multi-needle stitching machine was fully threaded with a 70-den (78-dtex), 34-filament textured polyester yarn. The front bar was threaded with air-jet entangled combination yarns of 140-denier (156-dtex) LYCRA® and 40-den (44-dtex) nylon. The front bar was threaded to obtain the following sequence of needle threading: the first twelve needles were triple-threaded; the next 168 needles were single threaded; and the next seven needles were double-threaded. The twelve triple-threaded needles and the seven double-threaded needles respectively formed the lower and upper elastic bands that became edges of the stitchbonded elastic fabric skirt. The threading pattern was repeated several times across the bar. The back bar inserted 1-0,1-2 tricot stitches and the front bar inserted 1-0,0-1,1-2,2-1 stitches into the overfed spunlaced sheet. Refer to FIG. 2 and FIG. 3 for further illustration of the stitch patterns and the preparation of the stitchbonded fabric skirt material. The skirt fabric comprised 29.2% textured polyester yarn, 27.8% elastic combination yarn and 43.0% spunlaced polyester fiber substrate. All percentages are based on the total weight of the stitchbonded skirt fabric. The stitchbonded fabric had a percent stretch of 140% in the longitudinal direction and of 210% in the transverse direction. The corresponding percent recoverable stretch was about 100% in the longitudinal direction and 65% in the transverse direction.

A 20.2-foot (6.16-meter) long, 14-inch (0.36-meter) wide stitchbonded skirt fabric, made as described above, was stretched about 10% in the longitudinal direction. Then, while stretched, the upper edge of the skirt fabric was sewn to a quilted top panel. The ends of the skirt fabric were then seamed together to complete the mattress cover. The mattress cover was fitted on a queen-size mattress that measured about 78-inches (1.9-m) long, 60-inches (1.52-m) wide and 9-inches (0.23-m) thick. The cover fit neatly, snugly, smoothly and completely around the sides and ends of the mattress. The cover was removed from the mattress and subjected to ten C-wash and drying cycles in a home automatic laundry and dryer. The cover was then refitted on the mattress with ease. The cover again fit neatly, snugly and smoothly around the entire side and ends of the mattress.

I claim:

1. An improved fitted mattress cover which comprises a top panel and a stitchbonded fabric skirt having a top edge and bottom edge, the top edge being attached to the periphery of the top panel and the skirt extending therefrom, the stitchbonded fabric skirt having a longitudinal direction parallel to the periphery of the top panel, a direction transverse thereto, and rows of tricot stitches formed with conventional inelastic yarn extending in the longitudinal direction of the skirt, and the bottom edge and/or the top edge of the stitchbonded fabric skirt optionally having elastic yarns stitched therein, the improvement comprising the stitchbonded fabric skirt being a two-bar fabric, one bar being of the tricot stitches and a second bar of stitches formed with elastic yarns, and the fabric having a percent stretch in the longitudinal direction of at least 50% and a percent stretch in the transverse direction of at least 100%, with at least 80% recoverable stretch in the longitudinal direction and at least 30% recoverable stretch in the transverse direction being recoverable.

2. A mattress cover in accordance with claim 1 wherein the second bar forms a repeating pattern of 1-0,0-1,1-2,2-1 stitches with elastic combination yarn.

3. A mattress cover according to claim 2 wherein the tricot stitches are 1-0,1-2 or 1-0,2-3 stitches formed with textured polyester yarn, the elastic combination yarn is of nylon filaments and spandex, and all the yarns are multi-needle stitched into a substantially nonbonded spunlaced layer of polyester fibers.

* * * * *